US005722764A

United States Patent [19]

Jou

[11] Patent Number: 5,722,764

[45] Date of Patent: Mar. 3, 1998

[54] ADJUSTABLE FLASHLIGHT

[76] Inventor: Wen San Jou, P. O. Box 82-144, Taipei, Taiwan

[21] Appl. No.: 741,550

[22] Filed: Oct. 31, 1996

[51] Int. Cl.[6] ..... F21L 15/20

[52] U.S. Cl. ..... 362/198; 362/196; 362/285; 362/418

[58] Field of Search ..... 362/194, 196–200, 362/202, 205, 206, 208, 285, 418, 419

[56] References Cited

U.S. PATENT DOCUMENTS

| | | | |
|---|---|---|---|
| 2,272,040 | 2/1942 | Muldoon | 362/196 |
| 3,111,277 | 11/1963 | Grimsley | 362/197 |
| 3,711,703 | 1/1973 | Bacevius | 362/196 |
| 4,403,274 | 9/1983 | Moore | 362/196 |
| 4,754,378 | 6/1988 | Chen | 362/196 |
| 5,119,280 | 6/1992 | Yang | 362/200 |
| 5,517,392 | 5/1996 | Rousso et al. | 362/198 |

*Primary Examiner*—Alan Cariaso
*Attorney, Agent, or Firm*—A & J

[57] ABSTRACT

An adjustable flashlight including a lamp housing having a lower cover and an upper cover adapted to engage with the lower cover, a battery chamber having a lower portion, an upper portion adapted to engage with the lower portion to form a container, and a cap sealably engaged with an end of the container, and a connecting member having an outer tube, an inner tube fitted within the outer tube, and a flexible rod arranged within the inner tube, whereby the adjustable flashlight can be bent to form any desired shape, limited only by the elasticity of the material of the connecting member.

1 Claim, 4 Drawing Sheets

FIG. 1

ADJUSTABLE FLASHLIGHT

BACKGROUND OF THE INVENTION

1. Field of the Invention

This invention relates to an adjustable flashlight and in particular to one which can be bent to form any desired shape, limited only by the elasticity of the material.

2. Description of the Prior Art

It has been found that flashlights of varying sizes, shapes and switch configurations are well-known in the art. Most prior art flashlights utilize dry cell batteries as their source of electrical energy. Two or more batteries are carried in series within a barrel which serves as a handle for the flashlight. Generally, an electrical current is established from one electrode of the battery through a conductor to a switch, then through another conductor to another electrode of the lamp bulb. Actuation of the switch to complete the electrical circuit enables the electrical current to pass through the filament, thereby generating light which is typically focused by a reflector to form a beam of light.

However, as the barrel of such flashlights are rigid and cannot be bent, such flashlights cannot be used for giving light to curve corners or the like thereby causing much inconvenience in use. Furthermore, such flashlights are inconvenient to disposed in a knapsack or carry on one's clothes.

Therefore, it is an object of the present invention to provide an adjustable flashlight which can obviate and mitigate the above-mentioned drawbacks.

SUMMARY OF THE INVENTION

This invention related to an adjustable light.

It is the primary object of the present invention to provide an adjustable light which can be bent to form any desired shape, limited only by the elasticity of the material.

It is another object of the present invention to provide an adjustable light which is practical in use.

It is still another object of the present invention to provide an adjustable light which is simple in construction.

It still another object of the present invention to provide an adjustable light which is easy to manufacture.

It is a further object of the present invention to provide an adjustable light which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
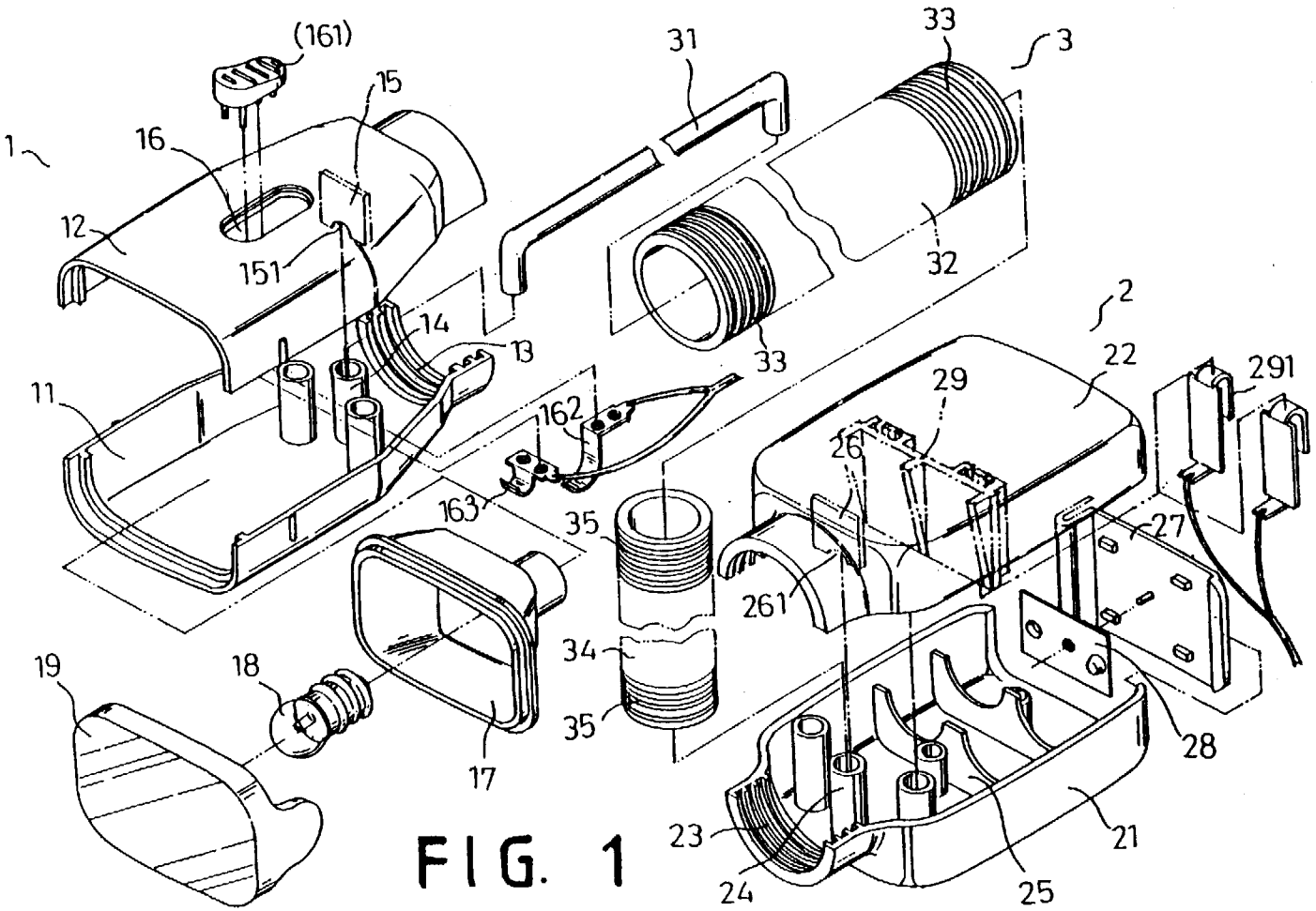
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
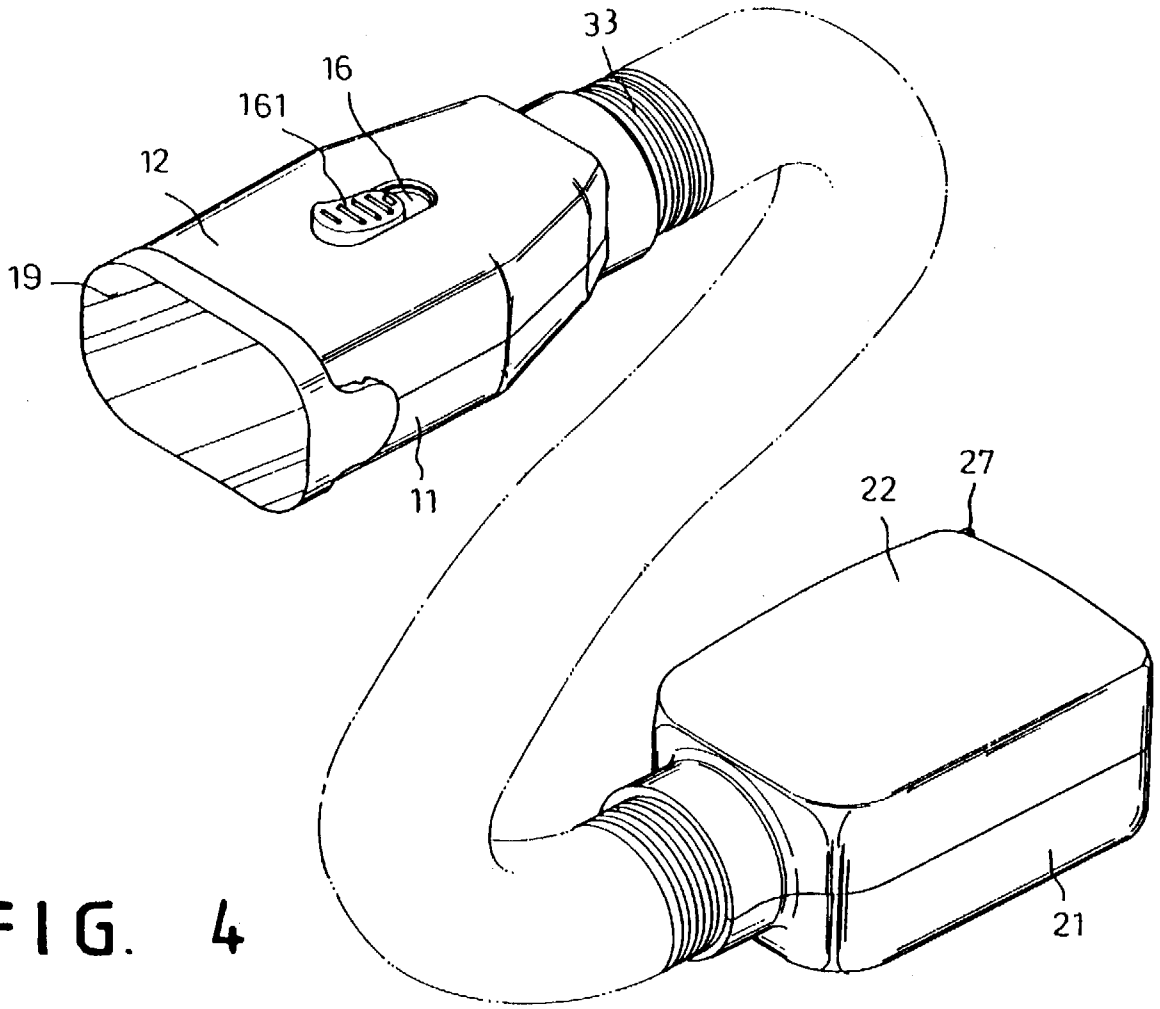
FIG. 4 is a perspective view of the present invention.

With reference to the drawings and in particular to FIGS. 1 and 4 thereof, the adjustable flashlight according to the present invention comprises a lamp housing 1, a battery chamber 2 and a connecting member 3 connecting the lamp housing 1 to the battery chamber 2.

The lamp housing 1 includes a lower cover 11 and an upper cover 12 adapted to engage with the lower cover 11. The lower and upper covers 11 and 12 are each formed at an end with a semi-circular neck portion having a plurality of semi-circular grooves 13 at the inner side. The lower cover 11 has a vertical tubular portion 14 close to the semi-circular grooves 13. The upper cover 11 has a depending panel 15 formed with a semi-circular recess 151 Just located above the tubular portion 14 of the lower cover 11. The intermediate portion of the upper cover 11 has an elongated slot 16 in which is slidably fitted an electrical switch 161. The switch 161 is provided with downwardly extending pins engaged with two conducting members 162 and 163. A reflector 17 is fixedly mounted at the front end of the lamp housing 1 and provided with an electrical socket for receiving a light bulb 18. A lens 9 is arranged on the reflector 17.

The battery chamber 2 includes a lower portion 21, an upper portion 22 adapted to engage with the lower portion 21 to form a container, and a cap 27 sealably engaged with an end of the container. The lower and upper portions 21 and 22 have a semi-circular neck portion at the other end formed with a plurality of semi-circular grooves 23 at the inner side. The lower portion 21 has a vertical tubular portion 24 close to its neck portion and two battery supporters 25 at its intermediate portion. The upper portion 22 is formed with two holders 29 for mounting electrodes 291. The upper portion 22 has a depending panel 26 formed with a semi-circular recess 261 just located above the tubular portion 24 of the lower portion 21. A conducting plate 28 is fixedly arranged on the inner side of the cap 27.

The connecting member 3 includes an outer tube 32, an inner tube 34 fitted within the outer tube 32, and a flexible rod 31 arranged within the inner tube 34. The flexible rod 31 is provided with two downwardly extending ends. The inner tube 34 is formed with a plurality of grooves 35 at its both ends. The outer tube 34 is also formed with a plurality of threads 33 at its both ends which are adapted to mesh with the grooves 13 of the lamp housing 1 and the grooves 23 of the battery chamber 2. Hence, the adjustable flashlight according to the present invention can be bent to form any desired shape, limited only by the elasticity of the material of the connecting member 3.

Figure 2A:
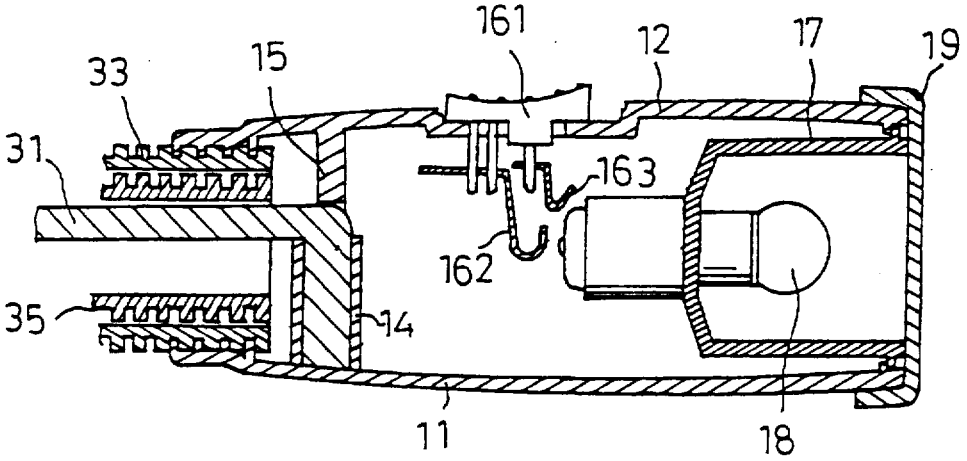
FIGS. 2A, 2B and 2C are sectional views of the lamp housing.
Figure 2B:
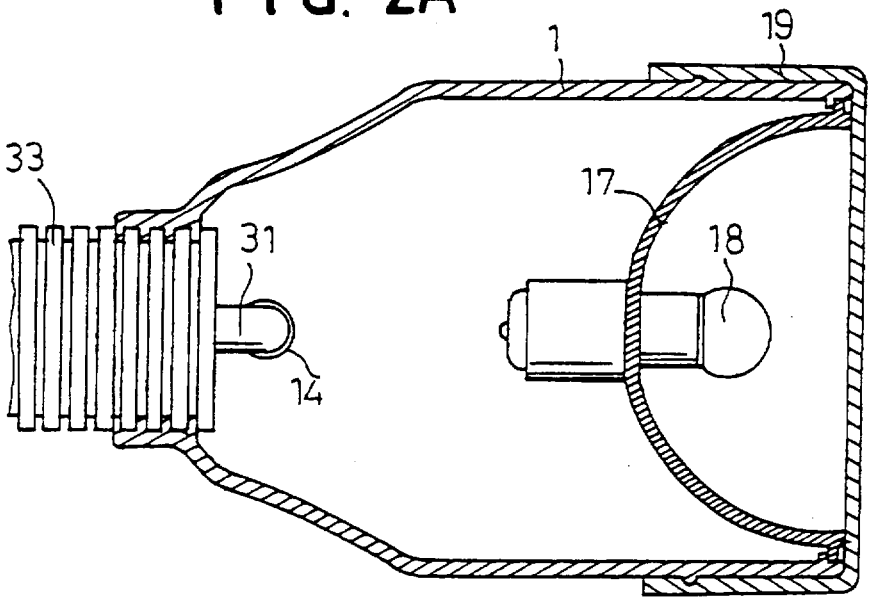
Figure 2C:
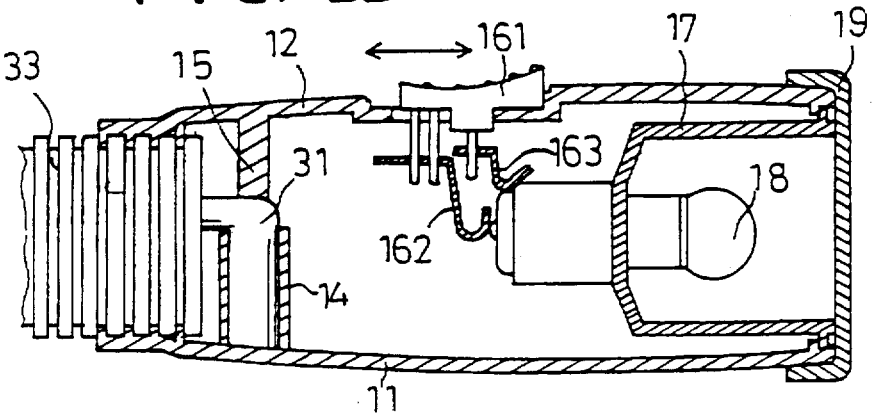
Figure 3A:
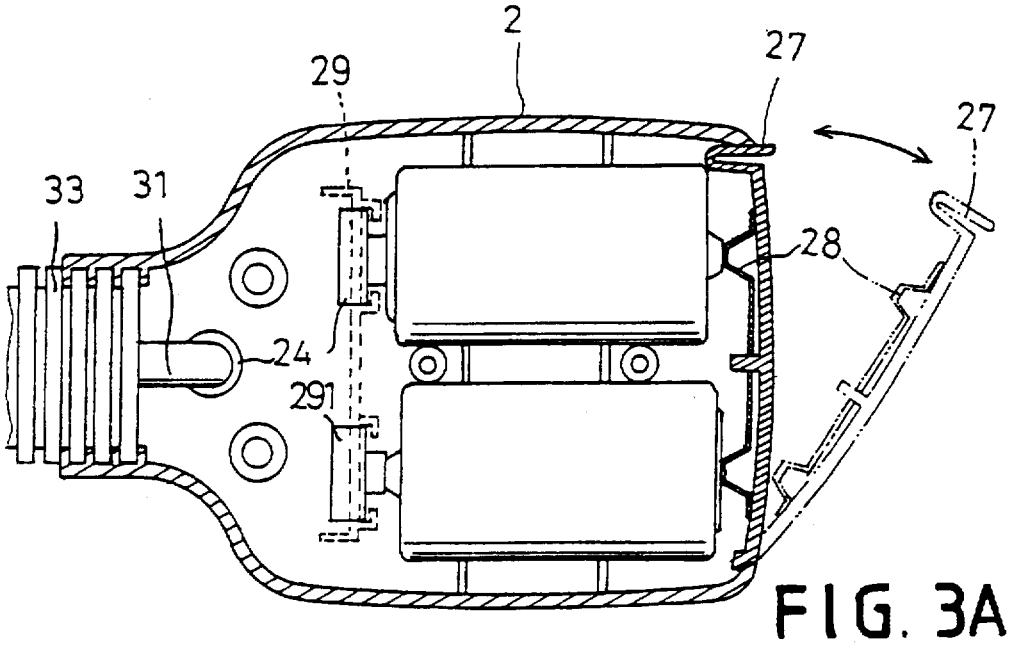
FIGS. 3A and 3B are sectional views of the battery chamber.
Figure 3B:
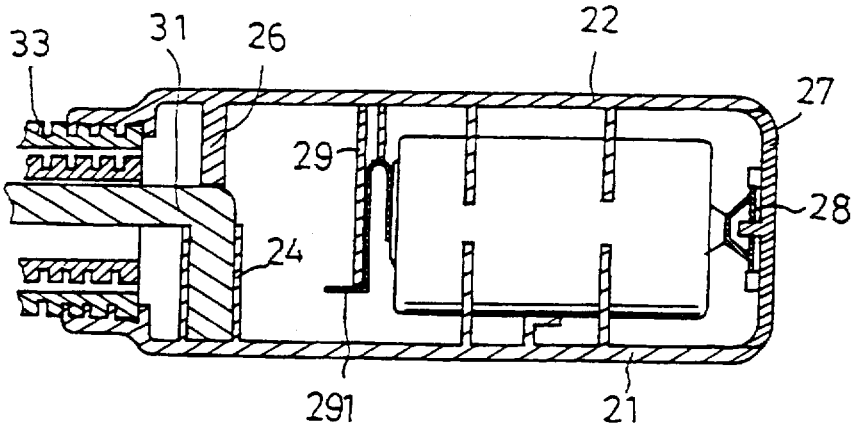

Referring to FIGS. 2A and 3A, the two downwardly depending ends of the flexible rod 31 are fitted into the vertical tubular portion 14 of the lower cover 11 of the lamp housing and the vertical tubular portion 24 of the lower portion 21 of the battery chamber 2, respectively. Furthermore, the flexible rod 31 are kept in place by the semi-circular recess 151 of the depending panel 15 of the lamp housing 1 and the semi-circular recess 261 of the depending panel 26 of the battery chamber 2 (see FIGS. 2A, 2C and 3B). The threads 33 of the outer tube 32 are engaged with the grooves 13 of the lamp housing 1 and the grooves 23 of the battery chamber 2 (see FIGS. 2B and 3B).

The working principles of the switch 161 is shown in FIG. 2C, while the cap 27 is engageable with the battery chamber 2 as shown in FIG. 3A.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An adjustable flashlight comprising:

a lamp housing including a lower cover and an upper cover adapted to engage with said lower cover, said lower and upper covers being each formed at an end thereof with a first semi-circular neck portion having a plurality of semi-circular grooves at an inner side of said first semi-circular neck portion, said lower cover having a first vertical tubular portion close to said semi-circular grooves, said upper cover having a first depending panel formed with a first semi-circular recess located above said first vertical tubular portion of said lower cover, an intermediate portion of said upper cover having an elongated slot in which is slidably fitted an electrical switch, said switch being provided with downwardly extending pins engaged with two conducting members, a reflector fixedly mounted at a front end of said lamp housing and provided with an electrical socket for receiving a light bulb, and a lens arranged on said reflector;

a battery chamber including a lower portion, an upper portion adapted to engage with said lower portion to form a container, and a cap sealably engaged with an end of said container, said lower and upper portions having a second semi-circular neck portion at another other end thereof formed with a plurality of second semi-circular grooves at an inner side of said second semi-circular neck portion of said lower and upper portions, said lower portion having a second vertical tubular portion close to its neck portion and two battery supporters at an intermediate portion thereof, said upper portion being formed with two holders on which are mounted two electrodes, said upper portion having a second depending panel formed with a second semi-circular recess located above said second vertical tubular portion of said lower portion, a conducting plate being fixedly arranged on an inner side of said cap; and a connecting member including an outer tube, an inner tube fitted within said outer tube, and a flexible rod arranged within said inner tube, said flexible rod being provided with two downwardly extending ends fitted into said first vertical tubular portion of said lower cover of said lamp housing and said second vertical tubular portion of said lower portion of said battery chamber, said flexible rod being kept in place by said first and second depending panels, said inner tube being formed with a plurality of grooves at both ends thereof, said outer tube being formed with a plurality of threads at both ends thereof which are adapted to mesh with said grooves of said lamp housing and said grooves of said battery chamber.

* * * * *